US009746283B2

(12) United States Patent
Braun

(10) Patent No.: US 9,746,283 B2
(45) Date of Patent: Aug. 29, 2017

(54) COCKING TAB INSERTS AND BREECHBLOCK SLIDES AND FIREARMS INCLUDING THE SAME

(71) Applicant: HECKLER & KOCH GmbH, Oberndorf (DE)

(72) Inventor: Daniel Braun, Sindelfingen (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 14/937,401

(22) Filed: Nov. 10, 2015

(65) Prior Publication Data

US 2016/0061562 A1 Mar. 3, 2016

Related U.S. Application Data

(63) Continuation of application No. PCT/EP2014/001252, filed on May 9, 2014.

(30) Foreign Application Priority Data

May 10, 2013 (DE) ..... 10 2013 008 091

(51) Int. Cl.

| | |
|---|---|
| ***F41C 27/00*** | (2006.01) |
| ***F41A 3/72*** | (2006.01) |
| ***F42C 3/00*** | (2006.01) |
| ***F41G 1/06*** | (2006.01) |

(52) U.S. Cl.

CPC ..... *F41C 27/00* (2013.01); *F41A 3/72* (2013.01); *F41G 1/06* (2013.01); *F42C 3/00* (2013.01)

(58) Field of Classification Search

CPC .. F41A 7/00; F41A 99/00; F41A 11/00; F41A 35/00; F41A 3/72; F41C 27/00; F41G 1/00; F41G 1/06; F41G 1/10; F41G 11/003; F41G 11/004

USPC ..... 89/1.4, 1.42; 42/85, 90, 106, 108, 71.02, 42/16

See application file for complete search history.

(56) References Cited

U.S. PATENT DOCUMENTS

| | | | |
|---|---|---|---|
| 1,680,186 | A | 8/1928 | Frommer |
| 5,735,070 | A | 4/1998 | Vasquez et al. |

(Continued)

FOREIGN PATENT DOCUMENTS

| | | |
|---|---|---|
| DE | 102005053373 | 5/2007 |
| GB | 2474538 | 4/2011 |
| JP | Sho 48-30079 | 9/1973 |

OTHER PUBLICATIONS

Japanese Patent Office, "Notice of the Reason for Refusal," issued in connection with Japanese Patent Application No. 2016-512251, Nov. 8, 2016, 6 pages.

(Continued)

*Primary Examiner* — Jonathan C Weber

(74) *Attorney, Agent, or Firm* — Hanley, Flight & Zimmerman, LLC

(57) ABSTRACT

Cocking tab inserts and breechblock slides and firearms including the same are disclosed. An example apparatus includes a breechblock slide; a cocking tab insert removably coupled to the breechblock slide; and a sight removably coupled to the breechblock slide and overlaying the cocking tab insert to substantially prevent the cocking tab insert from being inadvertently removed from the breechblock slide.

24 Claims, 5 Drawing Sheets

(56) References Cited

U.S. PATENT DOCUMENTS

| | | | | |
|---|---|---|---|---|
| 5,896,850 | A * | 4/1999 | Sullivan, Jr. | F41A 35/02 124/74 |
| 6,493,978 | B1 * | 12/2002 | Perkins | F41A 17/02 42/70.08 |
| 8,191,301 | B2 * | 6/2012 | Hatfield | F41A 19/34 42/90 |
| 8,312,803 | B2 * | 11/2012 | Oz | F41A 19/34 42/71.02 |
| 8,468,734 | B2 * | 6/2013 | Meller | F41A 3/72 42/71.02 |
| 8,887,432 | B2 * | 11/2014 | Oz | F41C 23/12 42/71.01 |
| 9,194,654 | B1 * | 11/2015 | Viani | F41C 27/00 |
| 9,267,759 | B2 * | 2/2016 | Speroni | F41C 27/00 |
| 9,328,991 | B2 * | 5/2016 | Gale | F41C 27/00 |
| 9,546,843 | B2 * | 1/2017 | Sroufe | F41A 3/72 |
| 2004/0200109 | A1 * | 10/2004 | Vasquez | F41A 19/01 42/1.01 |
| 2010/0024274 | A1 | 2/2010 | Lippard | |
| 2011/0010978 | A1 * | 1/2011 | Hooks | F41A 17/46 42/69.01 |
| 2011/0088539 | A1 * | 4/2011 | Oz | F41A 19/34 89/1.4 |
| 2011/0154710 | A1 | 6/2011 | Hatfield | |
| 2012/0198744 | A1 | 8/2012 | Meller et al. | |
| 2013/0111799 | A1 * | 5/2013 | Lee | F41G 11/001 42/106 |
| 2013/0180152 | A1 * | 7/2013 | Speroni | F41C 27/00 42/99 |
| 2013/0283660 | A1 * | 10/2013 | Matthews | F41G 1/30 42/113 |
| 2014/0298703 | A1 * | 10/2014 | Gale | F41C 27/00 42/71.02 |
| 2015/0121734 | A1 * | 5/2015 | Kresser | F41C 3/00 42/16 |
| 2016/0102938 | A1 * | 4/2016 | Sroufe | F41C 3/00 42/16 |

OTHER PUBLICATIONS

German Patent Office, "Office Action," issued in connection with German Application No. 10 2013 008 091.6, issued on Apr. 4, 2014, 8 pages.

Patent Cooperation Treaty, "International Search Report," issued in connection with PCT Application No. PCT/EP2014/001252, issued on Jul. 29, 2014, 5 pages.

Patent Cooperation Treaty, "Written Opinion," issued in connection with PCT Application No. PCT/EP2014/001252, issued on Jul. 29, 2014, 10 pages.

Patent Cooperation Treaty, "International Preliminary Report on Patentability and Written Opinion," issued in connection with PCT Application No. PCT/EP2014/001252, issued on Nov. 10, 2015, 12 pages.

* cited by examiner

COCKING TAB INSERTS AND BREECHBLOCK SLIDES AND FIREARMS INCLUDING THE SAME

RELATED APPLICATION

This patent is a continuation of International Patent Application Serial No. PCT/EP2014/001252, filed on May 9, 2014, which claims priority to German Patent Application 10 2013 008 091.6, filed on May 10, 2013. Priority is claimed of International Patent Application Serial No. PCT/EP2014/001252 and German Patent Application 10 2013 008 091.6. International Patent Application Serial No. PCT/EP2014/001252 and German Patent Application 10 2013 008 091.6 are incorporated herein by reference in their entireties.

FIELD OF THE DISCLOSURE

This patent relates generally to breechblocks and, more specifically, to cocking tab inserts and breechblock slides and firearms including the same.

BACKGROUND

Firearms such as pistols include breechblock slides. Some breechblock slides include a U-shaped cross-sectional profile that is movably disposed on and/or within the pistol. In some examples, the breechblock slide assists a marksman in loading and/or cocking the pistol.

DETAILED DESCRIPTION

Figure 1:
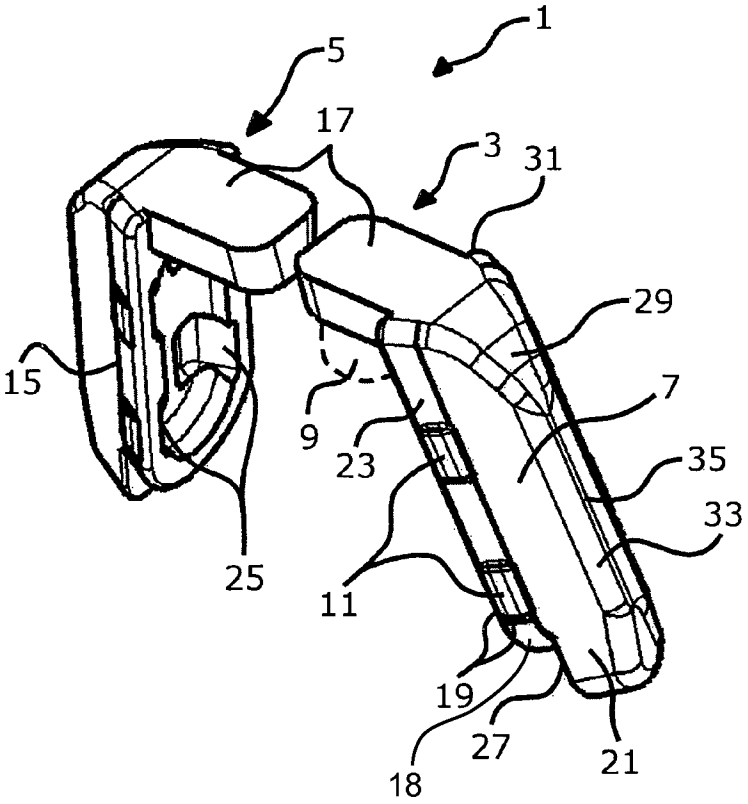
FIG. 1 illustrates a perspective view of example cocking tab inserts.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

In some examples, to chamber an unfired cartridge and/or round within a pistol, a marksman may use one hand to grip and/or hold the handle and/or butt of the pistol and another hand to grip and/or hold the breechblock slide. To chamber the round, the marksman pulls the breechblock slide backward until the breechblock slide stops against the spring force of a bolt spring within the handle and/or a hammer of the pistol. In some examples, as the breechblock slide slides over a magazine housed within the pistol, an opening is exposed that enables a cartridge to move from the magazine, via a force of a magazine spring, and into a movement path of the breechblock slide. In some examples, after the breechblock slide is released from the rearward position, the breechblock slide moves forward, via a force of a bolt spring, and engages and moves the cartridge forward into a cartridge chamber of the pistol. With the unfired cartridge within the cartridge chamber, the pistol is loaded and ready to fire. In some examples, pistols include a hammer. In some examples, pistols do not include a hammer.

In examples in which the pistol includes a hammer, the hammer is cocked when loading and/or reloading the pistol for firing. To fire the round and/or the firearm, the marksman actuates the trigger to release the hammer that engages the firing pin and causes the firing pin to strike a primer of the cartridge to fire the cartridge. After the cartridge is fired, the breechblock slide extracts the empty and/or fired cartridge casing from the cartridge chamber, discards the empty cartridge casing and introduces a new, unfired cartridge into the cartridge chamber.

In examples in which the pistol is a hammerless pistol, the firing pin spring acts as and/or assumes the function of the hammer. In such examples, as the breechblock slide moves forward from the rear position, a trigger lever of a trigger mechanism retains the firing pin in a secured position and the breechblock slide compresses a firing pin spring. To fire the round and/or the firearm, the marksman actuates the trigger to release the tensioned firing pin which enables the firing pin to strike a primer of the cartridge to fire the cartridge. In examples which the pistol is a double acting pistol, actuating the trigger tensions the firing pin spring.

In examples in which the pistol is a hammerless pistol, a spring force of the firing pin spring is great enough to provide a sufficient striking force on the primer of the cartridge to ensure the cartridge is fired. To enable the breechblock slide to compress the firing pin spring when the breechblock slide moves forward, hammerless pistols may have a bolt spring with a greater spring force than the spring force of bolt springs of pistols having a hammer. Thus, with hammerless pistols, a greater force may be exerted by the marksman when pulling the breechblock slide rearward to load the firearm as compared to pistols having a hammer.

Some marksman have difficulty retracting the breechblock slide because of the spring force of the bolt spring that acts on the breechblock slide. In some examples, the anatomy of the marksman may create challenges when retracting the breechblock slide against the spring force of the bolt spring. For example, some marksman have smaller hands, have less gripping strength, etc. In some examples, the hand of the marksman may slip when attempting to retract the breechblock slide if the breechblock slide is wet, dirty and/or oily, etc.

To assist in retracting breechblock slides, some example breechblock slides have enlarged gripping surfaces. In some examples, the enlarged gripping surfaces are gripped by a hand of the marksman when the breechblock slide is retracted to provide more force on projections of the gripping surfaces than lateral surfaces of the breechblock slide.

In some examples, the enlarged gripping surfaces enable the breechblock slide to be retracted with less force as compared to a breechblock slide without such enlarged gripping surfaces. In some examples, grooves are milled on the lateral walls of the breechblock slide to increase gripping.

A loading aid is mentioned in German Patent DE 10 2005 053 373 A1 that is intended to enable a pistol to be loaded with one hand. German Patent DE 10 2005 053 373 A1 is incorporated herein by reference in its entirety. In the example of German Patent DE 10 2005 053 373 A1, a holster including a claw housing is to be worn on the torso or leg of the marksman and a breechblock slide including two cams that protrude laterally from the breechblock slide. To retract the breechblock slide, the marksman inserts the pistol into the claw housing to enable the breechblock slide to be retained, via the cams, by the claw housing as the marksman urges the pistol into the holster to chamber a round.

A loading aid is included on the pistol, "Five SevenN," by the Belgian manufacturer FN Herstal. In the example of the Five SevenN pistol, lateral projections are integrally provided on a plastic sheath that encompasses the breechblock slide. Grooves are defined on sides of the breechblock slide that are intended to facilitate retracting the breechblock slide. These grooves and/or aids are inflexible in terms of handling and/or are unable to adapt to different ergonomic situations.

The examples disclosed herein relate to firearms including removable cocking tab inserts that enable firearms including such cocking tab inserts to be more easily cocked and/or for a round to be more easily chambered. In some examples, a first leg of the cocking tab inserts is received in opposing relatively vertically oriented dovetail grooves of an example breechblock slide and a second leg of the cocking tab inserts are received in opposing relatively horizontally oriented grooves of the breechblock slide using the examples disclosed herein. In some examples, projections of the first leg project from the sides of the breechblock slide to enable a marksman to easily grip and retract the breechblock slide. In some examples, the breechblock slide includes a sight groove that receives and/or couples the sight to the breechblock slide. The sight groove may be formed as a dovetail groove. In some examples, when the sight is coupled to the breechblock slide, the sight covers and/or overlays the second legs of the cocking tab inserts to substantially ensure that the cocking tab inserts are not inadvertently removed from the breechblock slide.

The examples disclosed herein relate to firearms including breechblock slides from which one or projections, cocking tab inserts, inserts, loading aids and/or charging supports are removably and/or releasably coupled. In some examples, the example breechblock slides have a U-shaped profile and include a loading aid on the breechblock slide.

FIG. 1 illustrates a perspective view of an example loading aid 1 including first and second inserts and/or cocking tab inserts 3, 5. In the illustrated example, the cocking tab inserts 3, 5 are mirror images of one another and have an inverted L-shaped cross section. In this example, the cocking tab inserts 3, 5 include first and/or longer portions and/or legs 7 and second and/or shorter portions and/or legs 17. When coupled to a breechblock slide 37 (FIG. 2), the second insert portions 17 extend toward one another and the first insert portions 7 extend downward along the breechblock slide 37.

Figure 2:
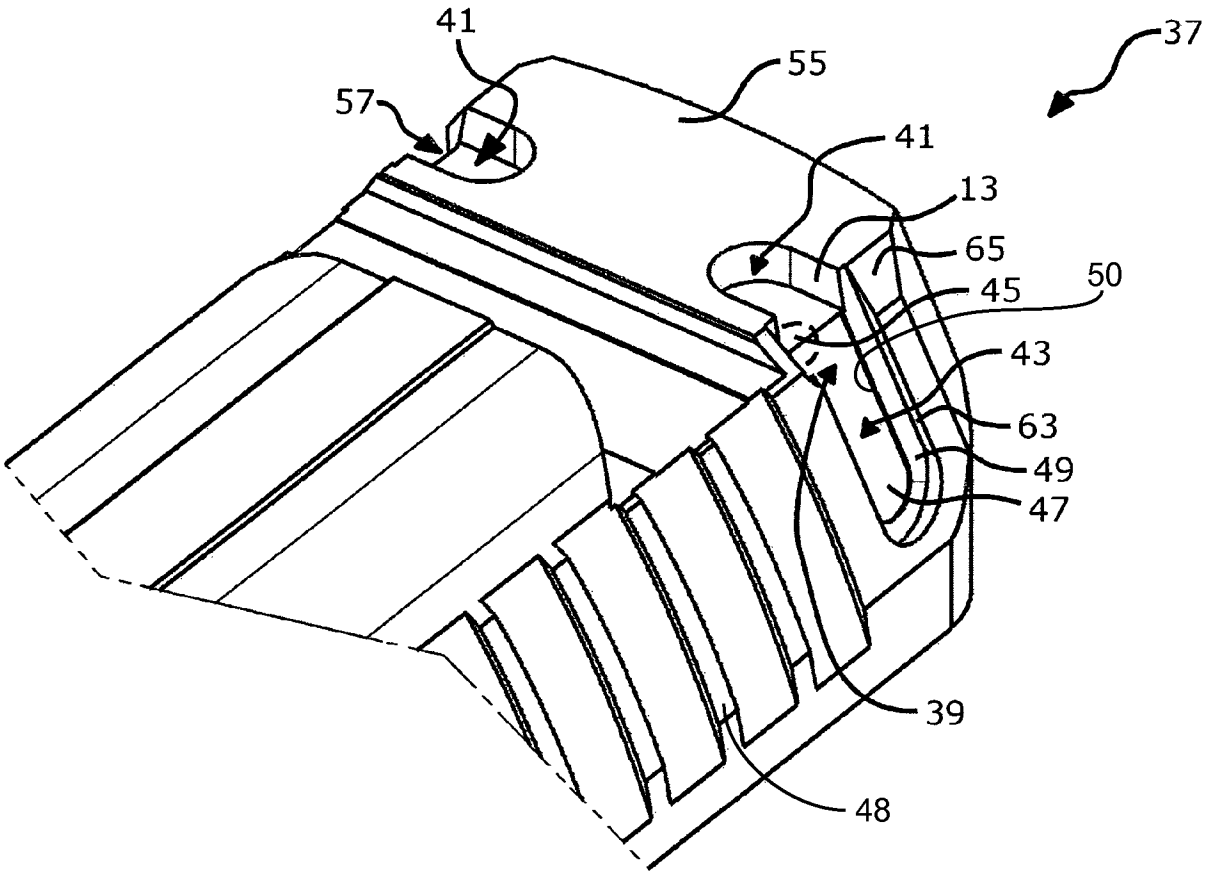
FIG. 2 illustrates a perspective view of an example breechblock slide.

Referring to both FIGS. 1 and 2, in the illustrated examples, to enable the cocking tab inserts 3, 5 and the breechblock slide 37 to be coupled (e.g., removably coupled), the breechblock slide 37 defines opposing and/or complementary recesses, channels and/or grooves 39. In some examples, the grooves 39 are mirror images of one another and are at least partially defined by lateral sides of the breechblock slide 37. In the illustrated example, an inner angle and/or profile 9 of the cocking tab inserts 3, 5 is formed between the first and second insert portions 7, 17. In some examples, the inner angle 9 is complementary to an outer angle and/or profile 45 of the recess 39 defined by the breechblock slide 37. In some examples, the inner angle 9 is between about approximately 90 degrees and 150 degrees and/or between about approximately 90 degrees and 115 degrees. In some examples, the outer angle 45 is between about approximately 90 degrees and 150 degrees and/or between about approximately 90 degrees and 115 degrees.

In the illustrated example, the first insert portion 7 includes an outer surface 21 having a projection and/or handle 33 and a base, guide surface and/or mounting base 18. In this example, the base 18 is sized and/or shaped to correspond to and/or complement the recess 39 of the breechblock slide 37. To increase the material elasticity of the cocking tab inserts 3, 5 regardless of the material used to manufacture the cocking tab inserts 3, 5, in some examples, the first insert portions 7 define internal cavities and/or recesses 25. The recesses 25 may enable sides of the cocking tab inserts 3, 5 to exert an outward force when the cocking tab inserts 3, 5 are inwardly urged.

In this example, the cocking tab inserts 3, 5 and/or the first insert portions 7 include a guide surface 23 that undercuts and/or mates with a counter-guide surface 63 of the recess 39. In some examples, the guide surface 23 and the counter-guide surface 63 include corresponding tapered surfaces. For example, the guide surface 23 may form a tongue of a tongue and groove connection and/or a dovetail groove connection and the counter-guide surface 63 may form a groove of the tongue and groove connection and/or the dovetail groove connection. When the cocking tab inserts 3, 5 are received within the respective recesses 39 and/or when the cocking tab inserts 3, 5 are coupled to the breechblock slide 37, the handle 33 projects from the outer surface 21 and forms and/or provides a gripping surface to enable a marksman to grip the breechblock slide 37 when the breechblock slide 37 is retracted to load the firearm. In some examples, the handle 33 projects diagonally outward and is provided on both sides and/or either side of a crown line and/or center line 35 of the respective cocking tab inserts 3, 5.

In some examples, the outer surface 21 of the cocking tab inserts 3, 5 is wider immediately adjacent the base 18 and forms a step and/or an excess 27 at an interface between the outer surface 21 and the guide surface 23. In the illustrated example, the outer surface 21 is relatively flat as the outer surface 21 transitions to the second insert portion 17. In this example, the second insert portion 7 is relatively planer. In some examples, the first insert portion 7 is wider than the second insert portion 17 such that a notch(es) is formed at the interface between the first and second insert portions 7, 17.

In the illustrated example, the first insert portions 7 include contours, surface structures and/or extensions 11 that facilitate the removable coupling between the cocking tab inserts 3, 5 and the breechblock slide 37. In some examples, the surface structures 11 are mirror images of one another and extend over the guide surface 23 of the base 18. To enable and/or facilitate the insertion of and/or removal of the cocking tab inserts 3, 5 from the recesses 37, edge surfaces 19 of the surface structures 11 are relatively flat. To enable the cocking tab inserts 3, 5 to be elastically received by the breechblock slide 37 in a clamping manner and/or to enable the cocking tab inserts 3, 5 to be elastically biasable, in some examples, the first insert portions 7 define the internal cavities 25. In some examples, the internal cavities 25 improve the fit (e.g., an interference fit) and/or coupling between the cocking tab inserts 3, 5 and the breechblock slide 37.

FIG. 2 illustrates a rear area of the breechblock slide 37 for a pistol or, more generally, a firearm. In some examples, the breechblock slide 37 includes recesses 39 that receive the respective bases 18 of the cocking tab inserts 3, 5 to couple the loading aids to the firearm. In this example, the recesses 39 are mirror images of one another and include a first portion and/or short recess section 41 and a second portion and/or long recess section 43. In this example, the first recess portion 41 receives the second insert portion 17 and the second recess portion 43 receives the first insert portion 7. In some examples, the first recess portion 41 and the second recess portion 43 are transverse to a longitudinal axis of the breechblock slide 37.

In some examples, the first recess portion 41 includes a semicircular portion that faces a semicircular portion of an opposing first recess portion 41. In some examples, the dimensions of the first recess portion 41 correspond to the dimensions of second insert portion 17. To provide a guide to facilitate and/or enable the insertion of the cocking tab inserts 3, 5 into the respective recesses 39, the first recess portion 41 includes lateral walls 13. In some examples, the lateral walls 13 are tapered and/or include the outer angle 45 that corresponds to the inner angle 9 of the cocking tab inserts 3, 5.

In the illustrated example, the second recess portion 43 includes a semicircular portion at a lower end that is spaced from the first recess portion 41. In some examples, the dimensions of the second recess portion 43 correspond to the dimensions of the first insert portion 7 and/or the dimensions of the guide surface 23 of the base 18. In some examples, a floor surface 49 of the second recess portion 43 is bounded by a step or an encircling step 50. In this example, a base surface 47 provided inside of the step 50 is deeper than the floor surface 49. In the illustrated example, a counter-guide surface and/or an encircling counter-guide surface 63 tapers from and/or is tilted toward the second recess portion 43 and adjoins and/or couples to the floor surface 49 toward the outside to form a guide, a swallowtail guide and/or a dovetail groove and/or guide.

As shown in the example of FIG. 2, to further facilitate the gripping of the breechblock slide 37, lateral surfaces of the breechblock slide 37 include ribs 48. In some examples, the ribs 48 may be mirror images of one another. In some examples, the ribs 48 are offset from one another. In some examples, the ribs 48 are different from one another. In some examples, the ribs 48 are similar or the same to one another.

Figure 3:
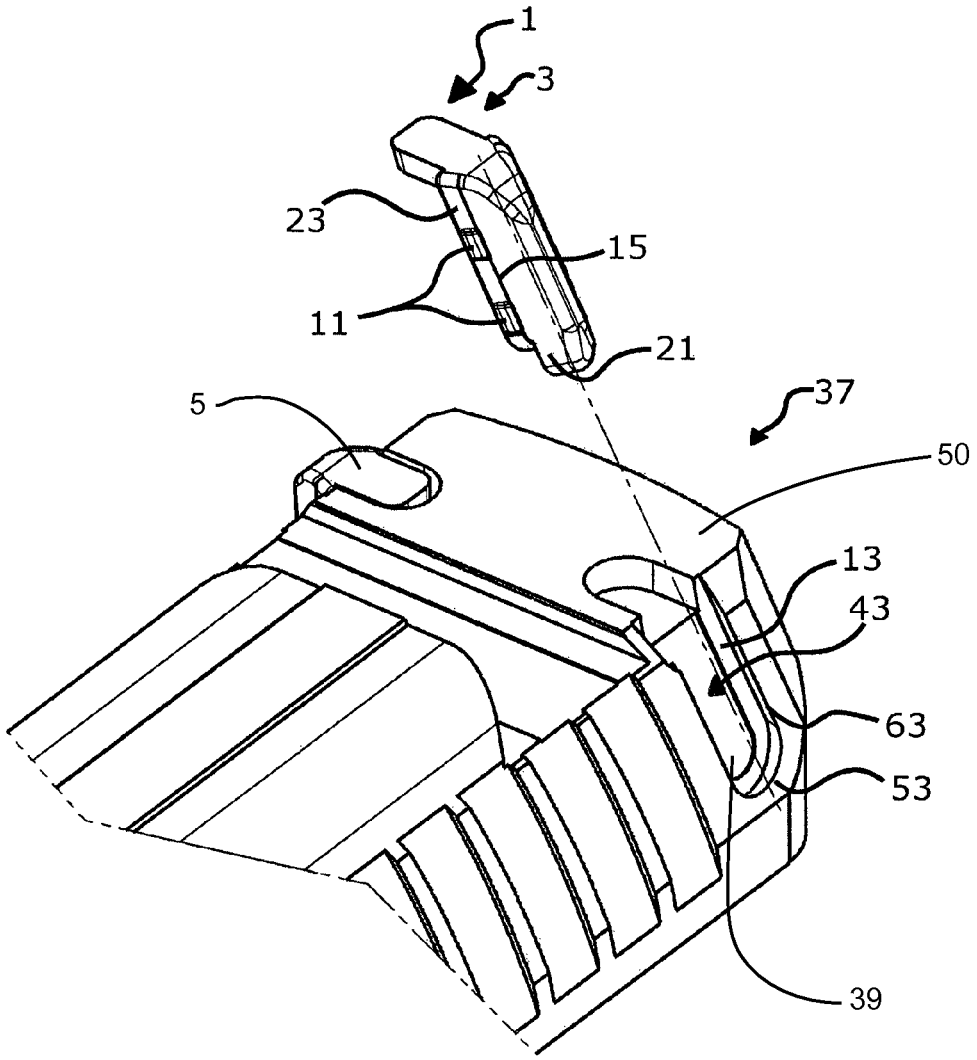
FIG. 3 illustrates a perspective expanded view of an example breechblock slide and example cocking tab inserts.

FIG. 3 illustrates the second cocking tab insert 5 disposed within and/or inserted into the right recess 39 and the first cocking tab insert 3 prior to being disposed within the left recess 39. When the first cocking tab insert 3 is inserted into the left recess 39, for example, the guide surface 23 engages and/or interacts with the counter-guide surface 63 of the second recess portion 43 from behind. In some examples, the guide surface 23 acts as the tongue of a tongue and groove connection and/or a dovetail groove connection and the counter-guide surface 63 acts as the groove of the tongue and groove connection and/or the dovetail groove connection. In some examples, as the first cocking tab insert 3 is further inserted into the left recess 39, the counter-guide surface 63 interacts with the surface structures 11 of the first cocking tab insert 3 to urge the surface structures 11 inward and toward a concave region and/or area of the base 18. In some examples, the cocking tab inserts 3, 5 are urged into the respective recesses 39 until the first insert portion 7 is fully received and/or accommodated in the second recess portion 43, an undersurface of the second insert portion 17 lies in the first recess portion 41 and/or the planer surface of the second insert portion 17 is substantially flush with a planer surface 55 of the breechblock slide 37. As set forth herein, substantially flush means that adjacent surfaces are within approximately a centimeter of one another and/or accounts for manufacturing tolerances.

Figure 4:
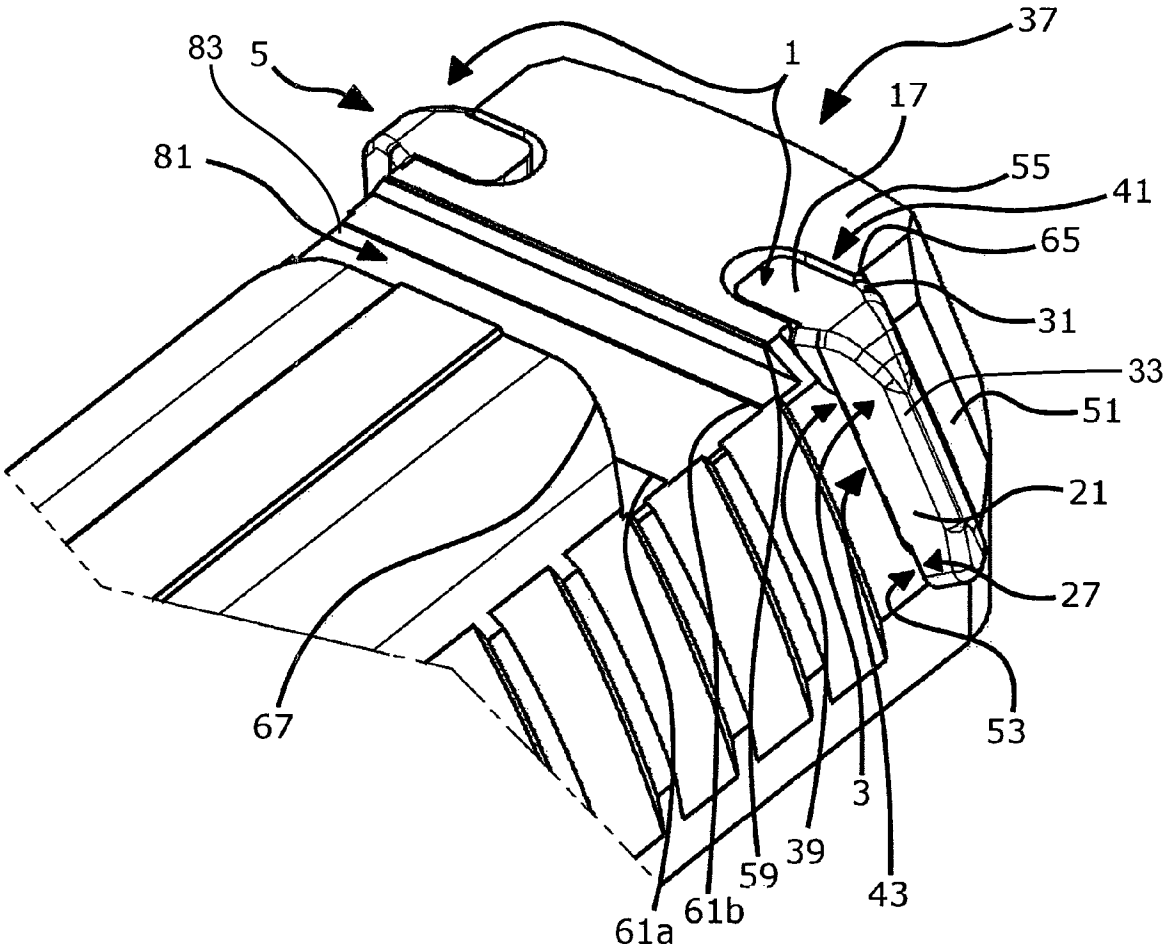
FIG. 4 illustrates a perspective view of an example breechblock slide and example cocking tab inserts coupled to the breechblock slide.

FIG. 4 illustrates the cocking tab inserts 3, 5 coupled to the breechblock slide 37 and/or disposed within the respective recesses 39. In some examples, to substantially prevent the cocking tab inserts 3, 5 from being inadvertently removed from the recesses 39, an interaction between the counter-guide surfaces 63 of the breechblock slide 37 and the surface structures 11 of the cocking tab inserts 3, 5 place the cocking tab inserts 3, 5 in a state of tension and provide an interference fit between the cocking tab inserts 3, 5 and the breechblock slide 37. As shown in FIG. 4, the handle 33 protrudes to the side and extends downward beyond the recess portion 43 to overlap an outer surface 51 of the breechblock slide 37 at an overlapping section and/or portion 53 of the breechblock slide 37.

Figure 5:
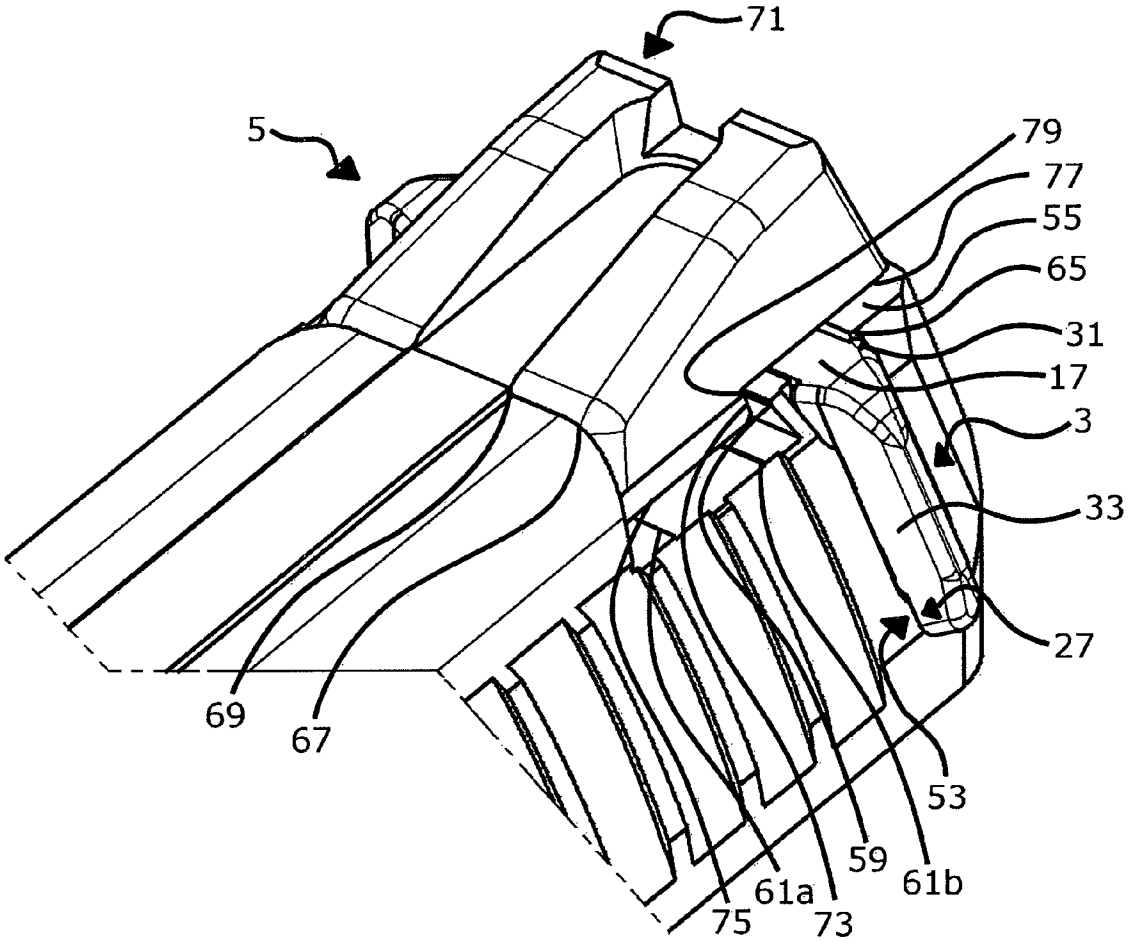
FIG. 5 illustrates a perspective view of an example breechblock slide and example cocking tab inserts coupled to the breechblock slide via a sight.

In the illustrated example, to enable a sight and/or a sight notch 71 (FIG. 5) to be coupled to the breechblock slide 37, the breechblock slide 37 defines a second recess and/or groove 81 transverse to the longitudinal axis of the breechblock slide 37 and forward of the first recess 39. As illustrated in the example of FIG. 5, to couple the sight 71 to the breechblock slide 37, a base and/or sight base 75 is received within the second groove 81, for example, from the side of the breechblock slide 37. In some examples, the sight base 75 acts as the tongue of a tongue and groove coupling and/or a dovetail groove coupling and guide surfaces 59 of the second groove 81 act as the groove of the tongue and groove coupling and/or the dovetail groove coupling. In the illustrated example, a surface and/or floor surface 83 of the recess 81 includes steps 61*a*, 61*b* at lateral edges of the surface 83.

FIG. 5 illustrates a perspective view of the cocking tab inserts 3, 5 and the sight 71 coupled to the breechblock slide 37. As shown in the example of FIG. 5, the sight 71 includes the base 75 that has surfaces that are complementary to surfaces of the second groove 81. In some examples, the sight 71 includes a surface, portion and/or undersurface 77 that extends over and/or overlaps the planer surface 55 of the breechblock slide 37. In some examples, the sight portion 71 overlaps and/or is disposed over the cocking tab inserts 3, 5 to couple and/or further couple the cocking tab inserts 3, 5 within the recesses 39. Thus, in some examples, the sight portion 71 secures the cocking tab inserts 3, 5 within the recesses 39 of the breechblock slide 37 to substantially prevent inadvertent removal of the cocking tab inserts 3, 5 from the breechblock slide 37. In some examples, the sight 71 and/or either of the cocking tab inserts 3, 5 can be coupled to the breechblock slide 37 in any other suitable way. For example, the sight 71 and/or the cocking tab inserts 3, 5 can be coupled to the breechblock slide 37 using a fastener(s), a screw(s), adhesive, a rivet(s), a clamp, etc.

As shown in the illustrated example of FIG. 5, in some examples, the breechblock slide 37 includes protrusions 69 to which the sight 71 can be positioned relative to after the cocking tab inserts 3, 5 have been positioned within the breechblock slide 37. Thus, the protrusions 69 may be used to facilitate the positioning and/or alignment of the sight 71 on the breechblock slide 37 in a position that readies the firearm for use and/or firing.

In some examples, blanks and/or lugs may be positioned within the recesses 39 instead of the cocking tab inserts 3, 5. In some examples, the blanks are similar to the cocking tab inserts 3, 5 but may not include the handle 33 such that an outer surface of the blank is relatively flush with an outer surface 51 of the breechblock slide 37 when the blanks are disposed within the respective recesses 39. When the blanks are disposed within the recesses 39 instead of the cocking tab inserts 3, 5, the example firearms disclosed herein can be fired and/or used.

The examples disclosed herein relate to pistols and/or firearms including example loading aids and/or breechblock slides including such example loading aids. In some examples, the example loading aids are secured beneath a fastener and/or a sight of a pistol to substantially prevent the loading aids from being inadvertently removed. In some examples, an undersurface of the sight substantially retains the loading aids within respective recesses defined by the breechblock slide. In some examples, the sight is received within a groove (e.g., a dovetail groove) of the breechblock slide to couple the sight to the breechblock slide.

In some examples, the sight includes a portion, a stepped portion and/or notch that extends over cocking tab inserts to secure the cocking tab inserts within the respective grooves of the breechblock slide. In some examples, the sight is received in a groove to secure the sight to the breechblock slide and/or to secure the cocking tab inserts within the breechblock slide. In some examples, the interaction between the sight groove and the sight enables the sight to be coupled to the breechblock slide without the use of additional tools and/or any tools.

In some examples, the cocking tab inserts and/or the loading aid is removably coupled and/or releasably mounted on pistols and/or firearms to enable the cocking tab inserts and/or the loading aid to be easily replaced and/or easily exchanged. In some examples, the example firearms include loading aids and/or cocking tab inserts that are separate parts. In some examples, the example firearms include loading aids and/or cocking tab inserts that are connected. For example, in some examples, the example loading aids disclosed herein fully and/or partially encompass the breechblock slide. In some examples, the example loading aids are provided on an outer surface(s) of the breechblock slide such as a lateral surface(s) and/or an upper surface(s) of the breechblock slide. In some examples, the example loading aids and/or the example sights are couplable to the example breechblock slides and/or the example firearms without tools.

In some examples, the example cocking tab inserts and/or the example sights are couplable to the example breechblock slides via an interference fit and/or a form-locking connection, etc. In some examples, a first base of a first cocking tab insert complements a first recess of the breechblock slide such that a form-fitting connection is provided when the example cocking tab insert is inserted into the recess.

In some examples, hammerless pistols may have a bolt spring including a higher spring force than the spring force of a bolt spring of a pistol having a hammer. Thus, to retract a breechblock slide of a hammerless pistol, a greater amount of force may be used than if the breechblock slide of a pistol having a hammer is retracted.

In some examples, the example cocking tab inserts may be designed and/or adapted to the hands of a marksman. For example, different cocking tab inserts may be provided for different ergonomic situations. For example, a marksman having a smaller hand, such as a female marksman, may prefer cocking tab inserts having a larger gripping surface and/or a larger loading aid. Alternatively, a marksman having a larger hand may prefer cocking tab inserts having a smaller gripping surface. Alternatively, a marksman may prefer to insert example blanks into the recesses of the breechblock slide. In some examples, the blanks have exterior surfaces that are relatively flush with a surface(s) of the breechblock slide. Thus, using the examples disclosed herein, cocking tab inserts having different sizes and/or configurations may be used with firearms depending on the specifications of the marksman.

In some examples, blanks and/or dummy lugs may be included with and/or inserted into recesses of the example breechblock slides to, for example, discourage dust and/or debris from collecting within the recesses and/or to provide additional flexibility that accommodates the preferences of different marksman. In some examples, depending on the climate in which the pistol is being used, the shape and/or size of the cocking tab inserts may change. For example, in areas having humid climates, cocking tab inserts having a larger surface area and/or a larger loading aid may be used. Alternatively, for example, in areas having arid climates, cocking tab inserts having a smaller surface area and/or a smaller loading aid may be used. In other words, the examples disclosed herein enable firearms to be dynamically customized for different climates, different environments, different anatomies and/or different marksman using easily replaceable cocking tab inserts of different sizes and/or configurations.

In some examples, the example pistols disclosed herein include cocking tab inserts on either side (e.g., the right side, the left side) of the pistol. In some examples, the cocking tab inserts are mirror images of one another. In some examples, the cocking tab inserts are offset from one another. For example, the cocking tab inserts may be offset relative to one another along the longitudinal axis of the firearm. In some examples, the cocking tab insert is provided on one lateral surface of the breechblock slide. In some examples, cocking tab inserts are provided on the lateral surfaces of the breechblock slide. In some examples, firearms on which the example loading aids are implemented include one cocking tab insert. In some examples, firearms on which the example loading aids are implemented include more than one cocking tab insert (e.g., 2, 3, 4, etc.).

In some examples, the cocking tab inserts provided and/or implemented on the example breechblock slides may be different shapes and/or sizes depending on the anatomy of the hand of the marksman and/or depending on the environment (e.g., the climate) in which the firearm is being used. In some examples, the example loading aid and/or the example cocking tab inserts have a U-shaped design that entirely and/or partially encompasses and/or covers the example breechblock slide. In some examples, the loading aid includes cocking tab inserts and/or inserts that are to be disposed and/or mounted on one or more sides of the breechblock slide. In some examples, the sides on which the cocking tab inserts are mounted include lateral sides of the breechblock slide, a top surface of the breechblock slide, etc.

In some examples, to account for different anatomies, different length index fingers, different length thumbs and/or to substantially prevent overextending of the hand when retracting the breechblock slide, in some examples, a first recess of the breechblock slide may be offset relative to a second recess of the breechblock slide. In some examples, the recesses and/or the breechblock slides are configured for a right handed shooter and/or configured for a left handed shooter. In some examples, the recesses for receiving the example cocking tab inserts are formed as mirror images of one another. In some examples, a first size cocking tab insert is used on one side of the firearm and a second size cocking tab insert is used on another side of the firearm. For example, a larger cocking tab insert may be provided on the side of the firearm that the thumb will placed and a smaller cocking tab insert may be provided on the side of the firearm that the index finger will be placed. In some examples, the examples disclosed herein are provided as a kit and/or assembly including a pistol, a breechblock slide and/or different cocking tab inserts of different sizes and/or different shapes and/or for different situations (e.g., different climates, different surface structures, etc.). In some examples, the different cocking tab inserts include blank cocking tab inserts.

In some examples, the example breechblock slide includes a first recess for releasably coupling and/or mounting a loading aid on and/or adjacent an outer upper surface of the breechblock slide. In some examples, the first recess is sized and/or configured to be complementary to a base of the loading aid and/or the loading aid to be received within the first recess. In some examples, the first recess and/or the loading aid is sized and/or configured to enable the loading aid to be retained within the first recess without additional fasteners other than, for example, the interaction between surfaces of the first recess and the loading aid. In some examples, the first recess is sized and/or configured to receive and/or retain different loading aids and/or different size loading aids. Thus, using the examples disclosed herein, a marksman can customize a firearm and/or pistol to their specifications by selecting and/or using different modular loading aids and/or different cocking tab inserts. In some examples, the first recess encases and/or is defined on three sides of the example breechblock slide. In some examples, the first recess encases and/or is defined on a portion of the breechblock slide. The recesses can be formed on the example breechblock slide using any suitable technology. For example, the first recess can be milled, etched, etc. In some examples, the first recess can be formed in the breechblock slide when the breechblock slide is initially manufactured. In some examples, the first recess can be formed in the breechblock slide after the breechblock slide is initially manufactured.

In some examples, the breechblock slides include at least one recess section formed on a lateral surface and/or an upper surface of the breechblock slide, transverse to a longitudinal axis of the breechblock slide. In some examples, the lateral positioning of the recess relative to a longitudinal axis of the breechblock slide enables the loading aid and/or the cocking tab inserts to be inserted into the breechblock slide from the top of the breechblock slide and/or along lateral sides of the breechblock slide. In some examples, the transverse arrangement of the recesses enables the example loading aid and/or example cocking tab inserts to be disposed within the example breechblock slide in an ergonomically advantageous manner. In some examples, the example recess partially extends over and/or is defined by the example breechblock slide. In some examples, the example recess entirely extends over and/or is defined by the example breechblock slide. In some examples, the first recess includes a first portion formed on a lateral surface of the breechblock slide and a second portion formed on an upper surface of the breechblock where the first and second portions are transverse to a longitudinal axis of the breechblock slide. In some examples, the first recess includes a guide surface(s) and/or dovetail groove to enable the example loading aid and/or example cocking tab inserts to be easily coupled to and/or removed from the example breechblock slides. In some examples, the guide surface(s) and/or the dovetail groove(s) facilitates and/or enables the loading aid and/or the cocking tab inserts to be coupled to and/or removed from the breechblock slide. In some examples, the first recess includes a dovetail groove that interacts with the loading aid and/or the cocking tab insert to couple the loading aid and/or the cocking tab inserts and the breechblock slide. In some examples, the loading aid and/or the cocking tab inserts are coupled to the firearm and/or the breechblock slide using one or more fasteners such as, for example, clamps, screws, adhesive, etc.

In some examples, the breechblock slide includes one or more recesses. In some examples, the recesses are offset relative to one another along a longitudinal axis of the firearm. In some examples, the recesses are mirror images of one another relative to a longitudinal axis of the firearm. Thus, using the examples disclosed herein, different marksman having different ergonomic requirements can use the examples disclosed herein to customize firearms to their desired specifications.

In some examples, the breechblock slide includes a second recess to receive a fastener and/or sight that interacts with the loading aid and/or the cocking tab inserts to substantially prevent the loading aid and/or the cocking tab inserts from being inadvertently removed from the breechblock slide. In some examples, the second recess is a dovetail groove. In some examples, the sight acts to secure the loading aid and/or cocking tab inserts within the example breechblock slide and aids the marksman in aiming the firearm. Thus, an additional fastener besides the sight may not be used when securing the example cocking tab inserts relative to the breechblock slide. In some examples, the sight includes a notch, a V-sight, a hole-sight or any other type of sighting device. In some examples, the sight includes an optical device(s), a laser supported device, a light and/or lighting means, etc. In some examples, the sight may be connected to the breechblock slide and/or to the loading aid and/or the cocking tab inserts by a screw, a rivet, adhesive, a clamp, etc.

In some examples, the first recess is positioned near and/or adjacent a rear portion of the breech block slide. In some examples, the loading aid and/or the cocking tab inserts have an L-shaped cross-section having an outer surface including a gripping portion and/or a projection. In some examples, the positioning of the projection(s) on the outer surfaces substantially ensures the example loading aid and/or the example cocking tab inserts are not installed onto the example breechblock slide incorrectly, for example.

In some examples, the first and/or second recesses are configured and/or designed to enable the sight to be coupled to the breechblock slide in a particular position such that adjusting the sight after the loading aid and/or the cocking tab inserts is not be needed. In some examples, the defined position of the sight may be obtained using an asymmetrical connection that may encourage the sight to be placed in a particular position with respect to the loading aid, the cocking tab inserts and/or the breechblock slide. In some examples, the loading aid and/or the cocking tab inserts are relatively inexpensive to manufacture and/or may be made of plastic, elastomer and/or a colored material that assists in visually identifying and/or relocating the loading aid and/or the cocking tab inserts if one were to, for example, drop and/or misplace the loading aid and/or one or more of the cocking tab inserts. In some examples, the recesses of the breechblock slide may be undersized and the cocking tab inserts may be oversized such that an interference fit is provided when the cocking tab inserts are received within the respective recesses. In some examples, the loading aid and/or the cocking tab inserts have contoured surfaces and/or complementary outer edges that interact with guide surfaces of the recesses of the breechblock slide to enable an interference fit to be provided that substantially prevents the example loading aid and/or the cocking tab inserts from being inadvertently removed from the breechblock slide.

In some examples, the loading aid and/or the cocking tab inserts protrude laterally from the breechblock slide between about 0.001 millimeters and 0.8 millimeters and/or between about 0.01 millimeters and 0.3 millimeters to provide a sufficiently large gripping surface for the marksman to grasp when retracting the breechblock slide. In some examples, a blank and/or dummy lug may be disposed within the recesses of the breechblock slide where the blank does not protrude from the breechblock slide but instead fills in and/or covers the recess(es) defined by the breechblock slide. In some examples, the blank is relatively flush with an exterior surface of the breechblock slide. In some examples, the blanks and/or lugs enable a marksman to use the example firearms disclosed herein without the loading aid and/or the cocking tab inserts. In some examples, the loading aids, the cocking tab inserts and/or the blanks disclosed herein include non-slipping outer surfaces. In some examples, the non-slipping outer surfaces include recesses, grooves, rubber, a coating, surface structures, etc. Thus, the example loading aid and/or cocking tab inserts disclosed herein can be easily used by a marksman wearing gloves, for example.

In some examples, the examples disclosed herein are provided as a retrofit assembly. In some examples, an example breechblock slide can be machined (e.g., milled) to accept the example loading aid and/or cocking tab inserts disclosed herein. In some examples, firearms can be retrofitted with the examples disclosed herein by replacing an existing breechblock slide with the example breechblock slide disclosed herein including the loading aid and/or cocking tab inserts.

As set forth herein, an example pistol having a breechblock slide 37 and a loading aid 1 disposed thereon, which protrudes in the form of at least one projection 21 from the outer surface of the breechblock slide 37, the loading aid 1 is releasably mounted on the breechblock slide 37, characterized in that the loading aid 1 is disposed beneath a sight element 71, and is secured against falling out by the base 75 thereof. In some examples, the loading aid 1 of which includes a loading aid insert 3, 5 on both sides of the breechblock slide 37 in each case, which are disposed in mirror image to one another, or offset to one another.

An example breechblock slide 37 for a pistol, having a substantially U-shaped profile and a loading aid 1, the loading aid 1 is releasably mounted on the breechblock slide 37, characterized in that the loading aid 1 thereof is disposed beneath a securing element, in particular a sight element 71, and is secured against falling out by the base 75 thereof. In some examples, the breechblock slide 37 includes a first recess 39 for the releasable mounting of the loading aid 1 in its outer surface 51, which is designed to be complementary to the mounting base 18 of the loading aid 1. In some examples, the first recess 39 of which includes at least one recess section 41, 43 formed on a lateral surface and/or upper surface of the breechblock slide 37 and running transverse to its longitudinal axis.

In some examples, the breechblock slide 37 includes the first recess 39 including a guide surface 63 for the insertion and removal of the loading aid 1 or one of its loading aid inserts 3, 5, which has a cut-out in the manner of a swallowtail guide. In some examples, the breechblock slide 37 includes the first recess 39 of which has a recess section 41, 43 on both sides of the breechblock slide 37 in each case, which are formed offset to one another or as mirror images of one another in relation to the longitudinal axis of the breechblock slide 37. In some examples, the breechblock slide 37 has at least one second recess 81 for receiving the securing element, in particular in the form of the sight element 71, which secures the installed loading aid 1 or the loading aid inserts 3, 5 thereof from falling out of the breechblock slide 37 or being displaced inside the breechblock slide 37, the second recess 81 has, in particular, a guide surface 59 in the manner of a swallowtail guide.

In some examples, the breechblock slide 37 includes the first recess 39 is provided in the rear end region thereof. An example loading aid 1 for a breechblock slide 37 includes the mounting base 18 of which is designed such that it is complementary to the first recess 39 in the breechblock slide 37. The loading aid 1 includes the loading aid inserts 3, 5 of which includes substantially L-shaped legs 7, 17, the outer surface(s) of which are designed as (a) projection(s) 21 that can be gripped.

The examples disclosed herein relate to a pistol having a breechblock slide 37 and a loading aid 1 disposed thereon, which protrudes in the form of at least one projection 21 from the outer surface of the breechblock slide 37 and is releasably mounted on the breechblock slide 37, the loading aid 1 thereof is disposed beneath a sight element 71 and is secured against falling out by the base 75 thereof. The examples disclosed herein relate to a breechblock slide 37 for a pistol, having a substantially U-shaped profile and a loading aid 1, which is releasably mounted on the breechblock slide 37, the loading aid 1 thereof is disposed beneath a sight element 71 and is secured against falling out by the base 75 thereof. The examples disclosed herein relate to a loading aid 1 for a breechblock slide 37, the mounting base 18 of which is designed such that it is complementary to a first recess 39 in the breechblock slide 37.

An example pistol having a breechblock slide 37 and a loading aid 1 disposed thereon, which protrudes in the form of at least one projection 21 from the outer surface of the breechblock slide 37, the loading aid 1 is releasably mounted on the breechblock slide 37, characterized in that the loading aid 1 is disposed beneath a sight element 71, and is secured against falling out by the base 75 thereof. In some examples, the loading aid 1 of which includes a loading aid insert 3, 5 on both sides of the breechblock slide 37 in each case, which are disposed in mirror image to one another, or offset to one another.

An example breechblock slide 37 for a pistol, having a substantially U-shaped profile and a loading aid 1, the loading aid 1 is releasably mounted on the breechblock slide 37, characterized in that the loading aid 1 thereof is disposed beneath a sight element 71, and is secured against falling out by the base 75 thereof. The breechblock slide 37 includes a first recess 39 for the releasable mounting of the loading aid 1 in its outer surface 51, which is designed to be complementary to the mounting base 18 of the loading aid 1. In some examples, the breechblock slide 37 includes the first recess 39 of which includes at least one recess section 41, 43 formed on a lateral surface and/or upper surface of the breechblock slide 37 and running transverse to its longitudinal axis. In some examples, the breechblock slide 37 includes the first recess 39 of which includes a guide surface 63 for the insertion and removal of the loading aid 1 or one of its loading aid inserts 3, 5, which has a cut-out in the manner of a swallowtail guide.

In some examples, the breechblock slide 37 includes the first recess 39 of which has a recess section 41, 43 on both sides of the breechblock slide 37 in each case, which are formed offset to one another or as mirror images of one another in relation to the longitudinal axis of the breechblock slide 37. In some examples, the breechblock slide 37 has at least one second recess 81 for receiving the securing element, in particular in the form of the sight element 71, which secures the installed loading aid 1 or the loading aid inserts 3, 5 thereof from falling out of the breechblock slide 37 or being displaced inside the breechblock slide 37, the second recess 81 has, in particular, a guide surface 59 in the manner of a swallowtail guide.

In some examples, the breechblock slide 37 includes the first recess 39 is provided in the rear end region thereof. In some examples, a loading aid 1 for a breechblock slide 37 includes the mounting base 18 of which is designed such that it is complementary to the first recess 39 in the breechblock slide 37. In some examples, the loading aid inserts 3, 5 of which includes substantially L-shaped legs 7, 17, the outer surface(s) of which are designed as (a) projection(s) 21 that can be gripped.

An example apparatus includes a pistol, including: a breechblock slide; a cocking tab insert removably housed within the breechblock slide; and a sight removably coupled to the breechblock slide and overlaying the cocking tab insert to substantially prevent the cocking tab insert from being inadvertently removed from the breechblock slide. In some examples, the cocking tab insert is a first cocking tab insert, further including a second cocking tab insert removably housed within the breechblock slide, the first cocking tab insert housed on an opposite side of the breechblock slide as the second cocking tab insert. In some examples, the first cocking tab insert is offset relative to the second cocking tab insert along a longitudinal axis of the breechblock slide. In some examples, the first cocking tab insert is a first size and the second cocking tab insert is a second size, the first size different than the second size. In some examples, the apparatus includes a third cocking tab insert, the third cocking tab insert to be housed within the breechblock slide when the first cocking tab insert is removed from the breechblock slide.

In some examples, the breechblock slide defines a groove that receives and houses the cocking tab insert. In some examples, the groove is a dovetail groove. In some examples, the groove is a first groove, further including a second groove defined by the breechblock slide, the second groove to receive the sight to removably couple the sight to the breechblock slide. In some examples, the second groove is a dovetail groove, further including a notch defined by the sight between a first portion of the sight and a second portion of the sight, the first portion to be received within the dovetail groove to couple the sight to the breechblock slide, the second portion to overlay the cocking tab insert. In some examples, the cocking tab insert is to be housed within the breechblock slide in tension to couple the cocking tab insert and the breechblock slide. In some examples, the cocking tab insert defines an inner channel to enable the cocking tab insert to be placed in tension when being housed within the breechblock slide. In some examples, the cocking tab insert is to extend from an exterior surface of the breechblock slide to provide a gripping surface.

An example apparatus includes a breechblock slide; a loading aid removably housed within the breechblock slide; and a sight removably coupled to the breechblock slide and overlaying the loading aid to substantially prevent the loading aid from being inadvertently removed from the breechblock slide, the loading aid to extend from an exterior surface of the breechblock slide to provide a gripping surface.

In some examples, the breechblock slide defines a recess to receive and housing the loading aid within the breechblock slide, the recess and the loading aid being complementarily sized. In some examples, the recess includes a first portion and a second portion, the first portion intersecting the second portion, the second portion being disposed on a lateral side of the breechblock slide. In some examples, the recess is transverse to a longitudinal axis of the breechblock slide. In some examples, the recess includes a dovetail groove to receive and housing the loading aid. In some examples, the recess is a first recess defined on a first side of the breechblock side, further including a second recess defined on a second side of the breechblock slide, the first side opposite the second side. In some examples, the loading aid is received in the first recess and the second recess. In some examples, the first recess is offset relative to the second recess along a longitudinal axis of the breechblock slide. In some examples, the first recess is a mirror image of the second recess. In some examples, the recess is defined adjacent a rear of the breechblock slide. In some examples, the loading aid is a first loading aid, further including a second loading aid removably housed within the breechblock slide, the first loading aid opposite the second loading aid. In some examples, the loading aid includes an L-shaped profile and an outer surface including a projection to enable gripping.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm, comprising:

a breechblock slide;

a cocking tab insert removably coupled to the breechblock slide; and a sight removably coupled directly to the breechblock slide and overlaying the cocking tab insert to prevent the cocking tab insert from being removed from the breechblock slide.

2. The firearm of claim 1, wherein the cocking tab insert is a first cocking tab insert, further including a second cocking tab insert removably coupled to the breechblock slide, the first cocking tab insert coupled on an opposite side of the breechblock slide as the second cocking tab insert.

3. The firearm of claim 2, wherein the first cocking tab insert is offset relative to the second cocking tab insert along a longitudinal axis of the breechblock slide.

4. The firearm of claim 2, wherein the first cocking tab insert is a first size and the second cocking tab insert is a second size, the first size different than the second size.

5. The firearm of claim 2, further including a third cocking tab insert, the third cocking tab insert to be coupled to the breechblock slide when the first cocking tab insert is removed from the breechblock slide.

6. The firearm of claim 1, wherein the breechblock slide defines a groove that receives and houses the cocking tab insert.

7. The firearm of claim 6, wherein the groove is a dovetail groove.

8. The firearm of claim 6, wherein the groove is a first groove, further including a second groove defined by the breechblock slide, the second groove to receive the sight to removably couple the sight to the breechblock slide.

9. The firearm of claim 8, wherein the second groove is a dovetail groove, further including a notch defined by the sight between a first portion of the sight and a second portion of the sight, the first portion to be received within the dovetail groove to couple the sight to the breechblock slide, the second portion to overlay the cocking tab insert.

10. The firearm of claim 1, wherein the cocking tab insert is to be coupled to the breechblock slide in tension to couple the cocking tab insert and the breechblock slide.

11. The firearm of claim 1, wherein the cocking tab insert defines an inner channel to enable the cocking tab insert to be placed in tension when being coupled to the breechblock slide.

12. The firearm of claim 1, wherein the cocking tab insert is to extend from an exterior surface of the breechblock slide to provide a gripping surface.

13. An apparatus, comprising:

a breechblock slide;

a loading aid removably coupled to the breechblock slide; and a sight removably coupled directly to the breechblock slide and overlaying the loading aid to prevent the loading aid from being removed from the breechblock slide, the loading aid to extend from an exterior surface of the breechblock slide to provide a gripping surface.

14. The apparatus of claim 13, wherein the breechblock slide defines a recess to receive the loading aid within the breechblock slide, the recess and the loading aid being complementarily sized.

15. The apparatus of claim 14, wherein the recess includes a first portion and a second portion, the first portion intersecting the second portion, the second portion being disposed on a lateral side of the breechblock slide.

16. The apparatus of claim 14, wherein the recess is transverse to a longitudinal axis of the breechblock slide.

17. The apparatus of claim 14, wherein the recess includes a dovetail groove to receive the loading aid.

18. The apparatus of claim 14, wherein the recess is a first recess defined on a first side of the breechblock slide, further including a second recess defined on a second side of the breechblock slide, the first side opposite the second side.

19. The apparatus of claim 18, wherein the first recess is offset relative to the second recess along a longitudinal axis of the breechblock slide.

20. The apparatus of claim 18, wherein the first recess is a mirror image of the second recess.

21. The apparatus of claim 14, wherein the recess is defined adjacent a rear of the breechblock slide.

22. The apparatus of claim 13, wherein the loading aid is a first loading aid, further including a second loading aid removably housed within the breechblock slide, the first loading aid opposite the second loading aid.

23. The apparatus of claim 13, wherein the loading aid includes an L-shaped profile and an outer surface including a projection to enable gripping.

24. The apparatus of claim 13, wherein the loading aid comprises:

a first leg;

a second leg coupled to the first leg, the first and second legs including an L-shaped cross-section, the first leg to be received in a first groove portion defined on a lateral side of the breechblock slide, the second leg to be received in a second groove portion defined by the breechblock slide, the first groove portion to intersect the second groove portion, when the first and second legs are received in the respective first and second groove portions, an outer surface of the first leg to extend from an exterior surface of the breechblock slide to provide a gripping surface, when the first and second legs are received in the respective first and second groove portions, the sight is to overlay the second leg to couple the loading aid to the breechblock slide.

* * * * *